US006663316B1

(12) United States Patent
Harris

(10) Patent No.: US 6,663,316 B1
(45) Date of Patent: Dec. 16, 2003

(54) SUPPORT FOR CONCRETE REINFORCING MEMBERS

(76) Inventor: Terry L. Harris, 9121 Millertown Pike, Mascot, TN (US) 37806

( * ) Notice: Subject to any disclaimer, the term of this patent is extended or adjusted under 35 U.S.C. 154(b) by 0 days.

(21) Appl. No.: 10/126,823

(22) Filed: Apr. 19, 2002

Related U.S. Application Data

(60) Provisional application No. 60/285,531, filed on Apr. 20, 2001.

(51) Int. Cl.[7] ..... E04C 5/16

(52) U.S. Cl. ..... 404/136; 52/677; 52/687

(58) Field of Search ..... 404/62, 135, 136; 52/677, 687

(56) References Cited

U.S. PATENT DOCUMENTS

| | | | | |
|---|---|---|---|---|
| 1,464,886 | A | 8/1923 | Snyder | |
| 3,673,753 | A | 7/1972 | Anderson | |
| 3,693,310 | A | 9/1972 | Middleton | |
| 3,788,025 | A | 1/1974 | Holmes | |
| 4,498,270 | A | 2/1985 | Ilukowicz | |
| 4,598,523 | A | 7/1986 | Tolliver | |
| 4,835,933 | A | 6/1989 | Yung | |
| 5,107,654 | A | 4/1992 | Leonardis | |
| 5,893,252 | A | 4/1999 | Hardy, Jr. et al. | |
| 6,276,108 | B1 * | 8/2001 | Padrun | 52/684 |
| 6,345,474 | B1 * | 2/2002 | Triplett | 52/169.9 |
| 6,354,054 | B1 * | 3/2002 | Verelli et al. | 52/686 |

FOREIGN PATENT DOCUMENTS

| | | | |
|---|---|---|---|
| JP | 9-221878 | * | 8/1997 |
| JP | 10-61109 | * | 3/1998 |

* cited by examiner

*Primary Examiner*—Gary S. Hartmann
(74) *Attorney, Agent, or Firm*—Luedeka, Neely & Graham, P.C.

(57) ABSTRACT

A structure is described for supporting concrete reinforcement bars in a substantially orthogonal relationship above a surface. The structure includes a base member having a central opening. At least a pair of long leg members extend upward from the base member on opposite sides of the central opening. At least a pair of short leg members also extend upward from the base member on opposite sides of the central opening, where the short leg members are positioned at about 90 degrees about the central opening relative to the long leg members. Attached to the upper extremities of the long leg members are upper bar-support members having opposing sidewalls which together form a upper channel therebetween. Similarly, attached to the upper extremities of the short leg members are lower bar-support members having opposing sidewalls which together form a lower channel therebetween. Each of the sidewalls of the upper bar-support members meet and are attached to an adjacent sidewall of one of the lower bar-support members at an angle of about 90 degrees. The upper bar-support members form an upper cradle for receiving an upper reinforcement bar, and the lower bar-support members form a lower cradle for receiving a lower reinforcement bar. To retain the reinforcement bars within the cradles, preferred embodiments of the invention include retaining members that protrude inward from the inner surfaces of the opposing sidewalls. These retaining members offer interference to any upward movement of the reinforcement bars.

10 Claims, 4 Drawing Sheets

SUPPORT FOR CONCRETE REINFORCING MEMBERS

This application claims priority to provisional patent application No. 60/285,531 filed Apr. 20, 2001, now abandoned.

TECHNICAL FIELD

The present invention is generally directed to structures for supporting concrete reinforcing members. More particularly, the invention is directed to a chair for supporting two reinforcing bars in an orthogonal relationship as concrete is poured to form a concrete slab.

BACKGROUND OF THE INVENTION

Steel reinforcement bars are typically used in concrete slabs and other concrete structures to provide structural support to the concrete. In slab applications, the bars are usually arranged in a rectangular lattice which is supported some distance above the ground or other surface on which the slab is to be poured. In this manner, the concrete may flow under and around the lattice, thereby encapsulating the lattice when the concrete hardens.

Prior structures for supporting the lattice above the ground, also referred to as chairs, have been lacking in several respects. Prior chairs have not provided stable support and have not effectively captured the reinforcing members to adequately keep them in the proper position as the concrete is poured. Also, some prior chairs have been difficult to use in that multiple pieces are required to capture the reinforcement bars. Further, many prior chair designs have been difficult to fabricate, which increases their cost.

What is needed, therefore, is an easy-to-use, low-cost structure for providing stable support for reinforcement bars in concrete slabs.

SUMMARY OF THE INVENTION

The foregoing and other needs are met by an apparatus for supporting reinforcement bars in a concrete structure. The apparatus includes a base member having a lower surface and an opposing upper surface, a pair of opposing first leg members extending upward from the upper surface of the base member, and a pair of opposing second leg members extending upward from the upper surface of the base member, where the second leg members are alternatingly disposed between the first leg members. An upper cradle is attached to the first leg members for receiving an upper reinforcement bar, and a lower cradle is attached to the second leg members for receiving a lower reinforcement bar.

The upper cradle comprises a first upper bar-support member and a second upper bar-support member. The first upper bar-support member has a pair of opposing first upper sidewalls separated by an upper channel, and the second upper bar-support member has a pair of opposing second upper sidewalls also separated by the upper channel.

The lower cradle comprises a first lower bar-support member and a second lower bar-support member. The first lower bar-support member has a pair of opposing first lower sidewalls separated by a lower-channel. One of the first lower sidewalls is attached to an adjacent one of the first upper sidewalls at an angle of about 90 degrees. Another of the first lower sidewalls is attached to an adjacent one of the second upper sidewalls at an angle of about 90 degrees. The second lower bar-support member has a pair of opposing second lower sidewalls separated by the lower channel. One of the second lower sidewalls is attached to an adjacent one of the first upper sidewalls at an angle of about 90 degrees. Another of the second lower sidewalls is attached to an adjacent one of the second upper sidewalls at an angle of about 90 degrees.

In a preferred embodiment, the apparatus includes upper retaining members protruding inwardly from the opposing first upper sidewalls and the opposing second upper sidewalls to retain the upper reinforcement bar within the upper cradle. These preferred embodiments also include lower retaining members protruding inwardly from the opposing first lower sidewalls and the opposing second lower sidewalls to retain the lower reinforcement bar within the lower cradle.

Preferably, the base member, first and second leg members, upper cradle, and lower cradle comprise a unitary structural element, such as a continuous piece of thermoplastic material formed by injection molding.

Brief Description of the Drawings

Further advantages of the invention will become apparent by reference to the detailed description of preferred embodiments when considered in conjunction with the drawings, which are not to scale, wherein like reference characters designate like or similar elements throughout the several drawings as follows.

DETAILED DESCRIPTION OF THE PREFERRED EMBODIMENT

Figure 5:
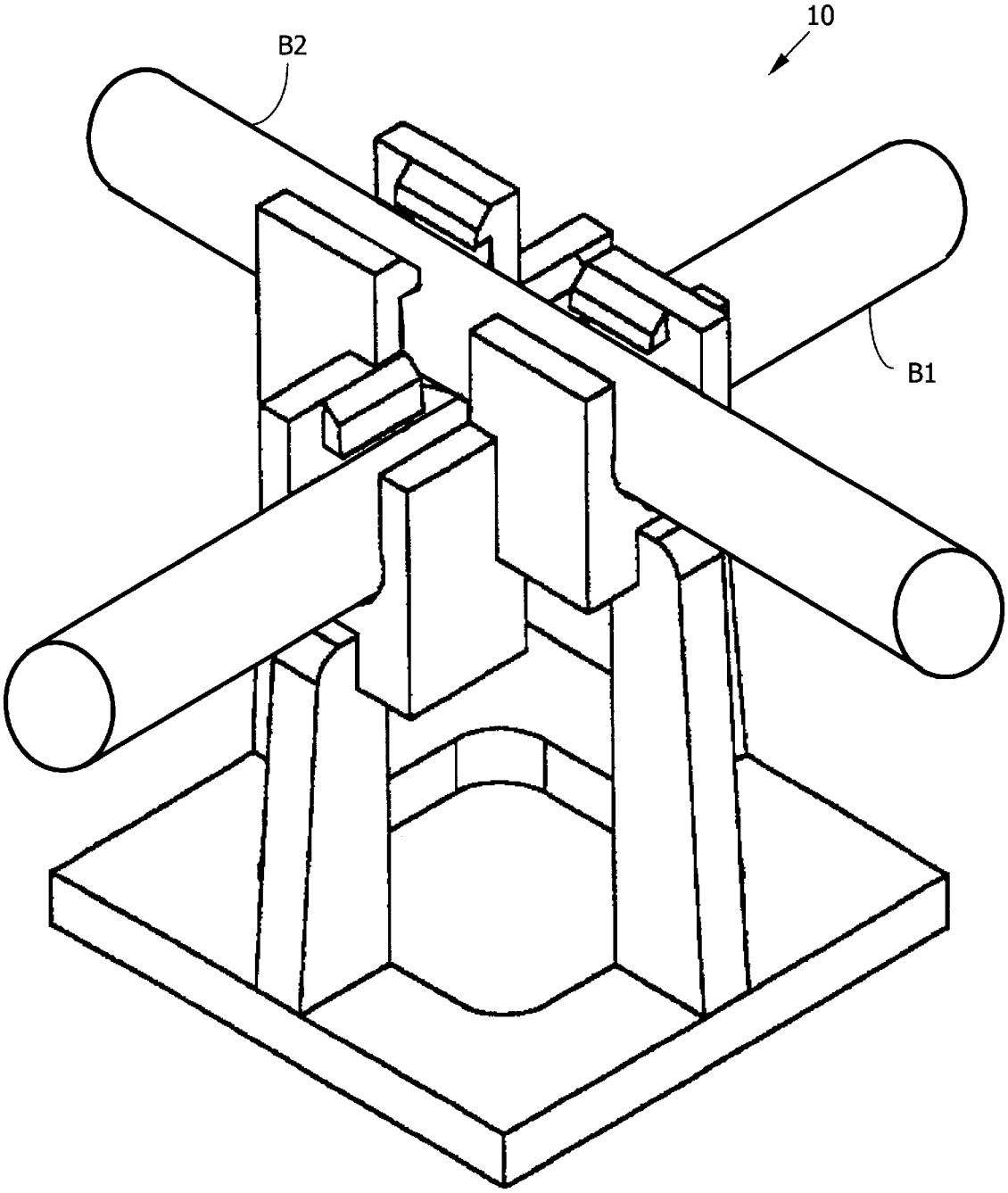
FIG. 5 is a perspective view of a structure that is supporting concrete reinforcement bars according to a preferred embodiment of the invention.

Depicted in FIGS. 1–5 is a structure 10 for supporting concrete reinforcement bars, also referred to herein as a re-bar chair. As shown in FIG. 5, the chair 10 may be used to hold two concrete reinforcement bars B1 and B2 in a substantially orthogonal relationship as concrete is poured around the chair 10 and the bars B1 and B2 to form a concrete structure. As one skilled in the art will appreciate, many such chairs 10 may be used to support a rectangular lattice of reinforcement bars in a concrete slab.

Figure 1:
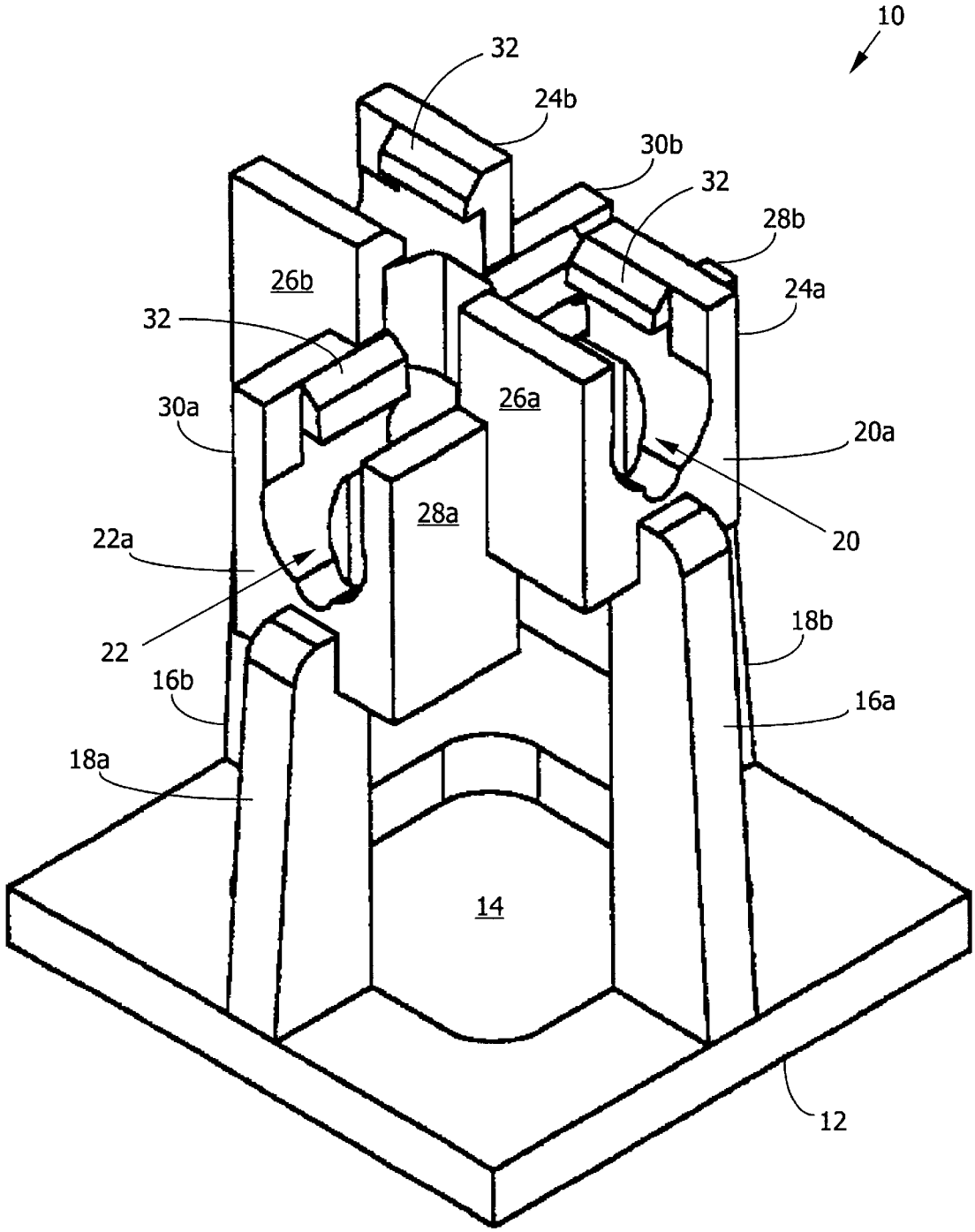
FIG. 1 is a perspective view of a structure for supporting concrete reinforcement bars according to a preferred embodiment of the invention.
Figure 2:
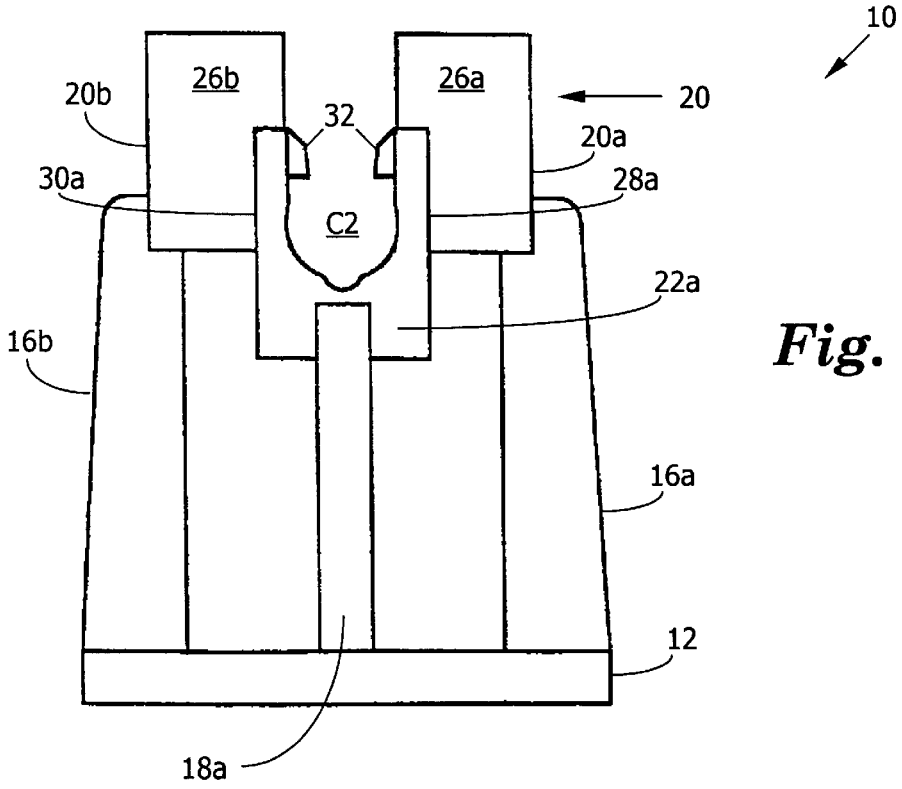
FIG. 2 is a first side view of a structure for supporting concrete reinforcement bars according to a preferred embodiment of the invention.
Figure 3:
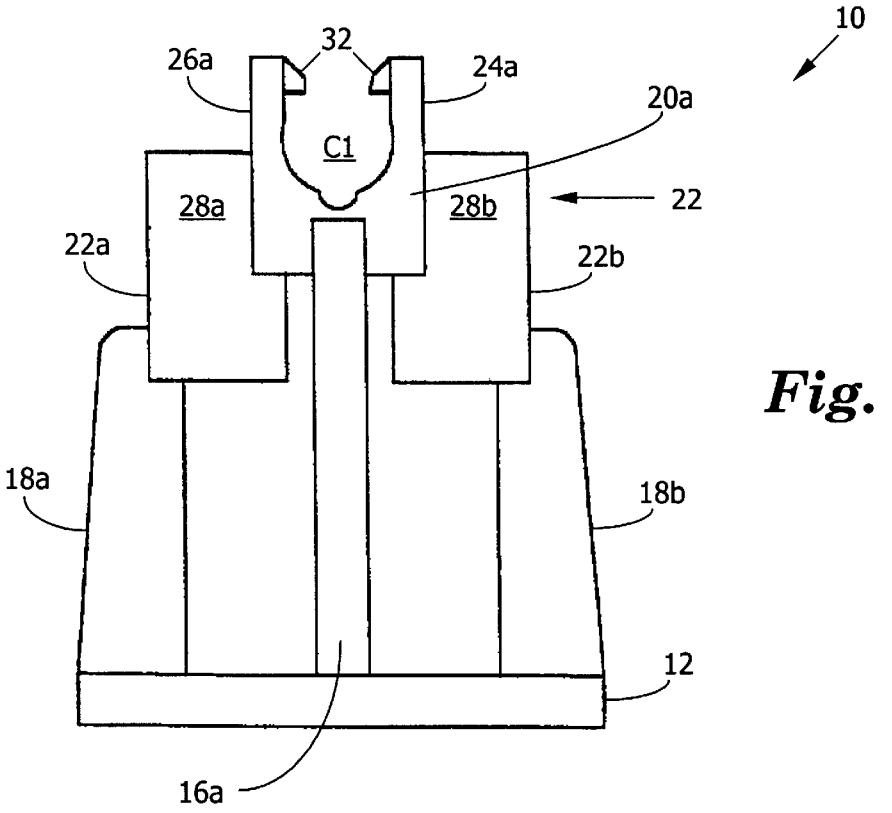
FIG. 3 is a second side view of a structure for supporting concrete reinforcement bars according to a preferred embodiment of the invention.
Figure 4:
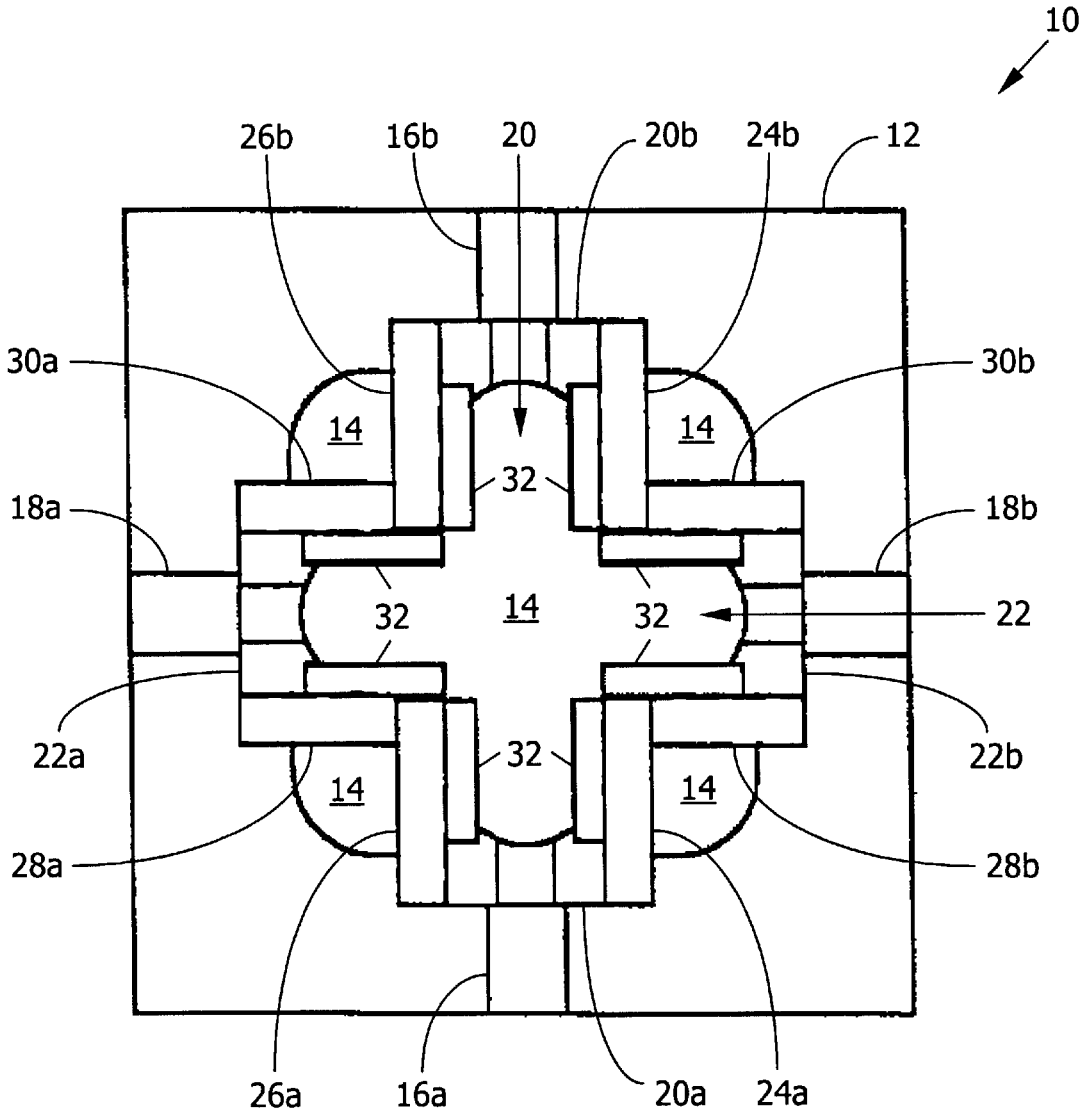
FIG. 4 is a top view of a structure for supporting concrete reinforcement bars according to a preferred embodiment of the invention.

The chair 10 includes a base member 12, which is preferably square, but which also could be circular, octagonal, or other shape. Within the base member 12, there is preferably an opening 14. Situated around the opening 14 are a set of leg members, including opposing long leg members 16*a* and 16*b* and opposing short leg members 18*a* and 18*b*. The leg members 16*a–b* and 18*a–b* are attached at their lower extremities to the base member 12 and extend upward therefrom. The leg members 16*a–b* and 18*a–b* of the preferred embodiment are rectangular in cross-section, and, as shown most clearly in FIGS. 2 and 3, are somewhat thicker at their lower extremities than at their upper extremities.

Attached to the upper extremity of the long leg member 16*a* is an upper bar-support member 20*a*, and attached to the upper extremity of the long leg member 16*b* is an upper bar-support member 20*b*. As shown most clearly in FIGS. 1 and 3, the upper bar-support member 20*a* includes opposing sidewalls 24*a* and 26*a*, which together form a channel C1 therebetween. Similarly, the upper bar-support member 20b includes opposing sidewalls 24*b* and 26*b*.

Attached to the upper extremity of the short leg member 18*a* is a lower bar-support member 22*a*, and attached to the upper extremity of the short leg member 18*b* is a lower bar-support member 22*b*. As shown most clearly in FIGS. 1 and 2, the lower bar-support member 22*a* includes opposing sidewalls 28*a* and 30*a*, which together form a channel C2 therebetween. Similarly, the lower bar-support member 22*b* includes opposing sidewalls 28*b* and 30*b*.

The sidewall 26*a* of the upper bar-support member 20*a* is attached to the sidewall 28*a* of the lower bar-support member 22*a*, and the sidewall 24*a* of the upper bar-support member 20*a* is attached to the sidewall 28*b* of the lower bar-support member 22*b*. Similarly, the sidewall 26*b* of the upper bar-support member 20*b* is attached to the sidewall 30*a* of the lower bar-support member 22*a*, and the sidewall 24*b* of the upper bar-support member 20*b* is attached to the sidewall 30*b* of the lower bar-support member 22*b*. Based on this arrangement, the lower bar-support members 22*a* and 22*b* form a lower cradle 22 for receiving a lower reinforcement bar (such as the bar B1 in FIG. 5), and the upper bar-support members 20*a* and 20*b* form an upper cradle 20 for receiving an upper reinforcement bar (such as the bar B2 in FIG. 5).

To prevent the reinforcement bars from lifting out of the cradles 20 and 22, on the inner surfaces of the opposing sidewalls 24*a*–26*a*, 24*b*–26*b*, 28*a*–30*a*, and 28*b*–30*b* are retaining members 32. As shown most clearly in FIGS. 2 and 3, the retaining members 32 extend slightly over the channels C1 and C2 to prevent the reinforcement bars from moving upward and out of the channels C1 and C2. As the FIGURES indicate, the upper surfaces of the retaining members 32 are beveled, sloped, or curved slightly downward so that when the bars are pressed downward toward the channels C1 and C2, force is transferred outward to cause the sidewalls 24*a*–*b*, 26*a*–*b*, 28*a*–*b*, and 30*a*–*b* to flex outward and allow the reinforcement bars to snap into the channels C1 and C2. The lower surfaces of the retaining members 32 are preferably not beveled, but rather have a square or barbed comers for effectively capturing the reinforcement bars within the channels C1 and C2. Compared to prior chair designs that have used opposing tapered slots in a conical or cylindrical wall, the opposing sidewalls and retaining members of the present invention provide a significantly improved retention mechanism.

In the preferred embodiment of the invention, all of the components of the chair 10 are formed from one continuous piece of thermoplastic, such as polypropylene, which, though rigid enough to support the weight of the reinforcement bars, is flexible enough to allow the sidewalls 24*a*–*b*, 26*a*–*b*, 28*a*–*b*, and 30*a*–*b* to flex outward to receive the reinforcement bars as described above. Thus, when a reinforcement bar is laid across the cradle 20 on top of the retaining members 32, and is pressed downward, the sidewalls 24*a*–*b* and 26*a*–*b* may flex outward to allow the reinforcement bar to slide past the retaining members 32 and snap into place in the channel C1. Similarly, when a reinforcement bar is laid across the cradle 22 on top of the retaining members 32, and is pressed downward, the sidewalls 28*a*–*b* and 30*a*–*b* may flex outward to allow the reinforcement bar to slide past the retaining members 32 and snap into place in the channel C2. Of course, if the chair 10 is used to support two orthogonal reinforcement bars, the lowermost bar must be snapped into the lower cradle 22 first, and then the uppermost bar may be snapped into the upper cradle 20.

In the preferred embodiment of the invention, the height of the lower cradle 22 above the base 12 is about three to four inches, which would place the reinforcement bars at about the center of a six to eight inch concrete slab. However, one skilled in the art will appreciate that with appropriate scaling of the base 12 and the leg members 16*a*–*b* and 18*a*–*b*, the height of the lower cradle 22 above the base 12 could be practically any desired value. Thus, the present invention is not limited to any particular height of the cradles 20 and 22 above the base 12.

As one skilled in the art will appreciate, the chair 10 as depicted in the FIGURES is designed to be formed using an injection molding process in a two-piece injection mold. For compatibility with a two-piece mold, the leg members 16*a*–*b* and 18*a*–*b* preferably lean slightly inward and have cross-sections which are preferably tapered from thicker to thinner from the lower to the upper extremities.

The foregoing description of preferred embodiments for this invention have been presented for purposes of illustration and description. They are not intended to be exhaustive or to limit the invention to the precise form disclosed. Obvious modifications or variations are possible in light of the above teachings. The embodiments are chosen and described in an effort to provide the best illustrations of the principles of the invention and its practical application, and to thereby enable one of ordinary skill in the art to utilize the invention in various embodiments and with various modifications as is suited to the particular use contemplated. All such modifications and variations are within the scope of the invention as determined by the appended claims when interpreted in accordance with the breadth to which they are fairly, legally, and equitably entitled.

What is claimed is:

1. An apparatus for supporting reinforcement bars in a concrete structure, the apparatus comprising:

a base member having a lower surface and an opposing upper surface;

a pair of opposing first leg members extending upward from the upper surface of the base member;

a pair of opposing second leg members extending upward from the upper surface of the base member, the second leg members alternatingly disposed between the first leg members;

an upper cradle attached to the first leg members for receiving an upper reinforcement bar, the upper cradle comprising:

a first upper bar-support member having a pair of opposing first upper sidewalls separated by an upper channel, and a second upper bar-support member having a pair of opposing second upper sidewalls separated by the upper channel; and a lower cradle attached to the second leg members for receiving a lower reinforcement bar, the lower cradle comprising:

a first lower bar-support member having a pair of opposing first lower sidewalls separated by a lower channel, one of the first lower sidewalls attached to an adjacent one of the first upper sidewalls at an angle of about 90 degrees, and another of the first lower sidewalls attached to an adjacent one of the second upper sidewalls at an angle of about 90 degrees, and a second lower bar-support member having a pair of opposing second lower sidewalls separated by the lower channel, one of the second lower sidewalls attached to an adjacent one of the first upper sidewalls at an angle of about 90 degrees, and another of the second lower sidewalls attached to an adjacent one of the second upper sidewalls at an angle of about 90 degrees.

2. The apparatus of claim 1 wherein the base member has a central opening disposed between the opposing first leg members and between the opposing second leg members.

3. The apparatus of claim 1 wherein the first leg members are longer than the second leg members.

4. The apparatus of claim 1 wherein:

the first upper sidewalls are substantially parallel to each other;

the second upper sidewalls are substantially parallel to each other;

each of the first upper sidewalls is substantially coplanar with an opposing one of the second upper sidewalls;

the first lower sidewalls are substantially parallel to each other;

the second lower sidewalls are substantially parallel to each other; and each of the first lower sidewalls is substantially coplanar with an opposing one of the second lower sidewalls.

5. The apparatus of claim 1 further comprising:

upper retaining members protruding inwardly from the opposing first upper sidewalls and the opposing second upper sidewalls to retain the upper reinforcement bar within the upper cradle; and lower retaining members protruding inwardly from the opposing first lower sidewalls and the opposing second lower sidewalls to retain the lower reinforcement bar within the lower cradle.

6. The apparatus of claim 1 wherein the base member, first and second leg members, upper cradle, and lower cradle comprise a unitary structural element.

7. The apparatus of claim 1 wherein the base member, first and second leg members, upper cradle, and lower cradle are formed from a continuous piece of thermoplastic material.

8. An apparatus for supporting reinforcement bars in a concrete structure, the apparatus comprising:

a base member having a lower surface, an opposing upper surface, and a central opening;

a pair of opposing first leg members extending upward from the upper surface of the base member, the first leg members disposed on opposing sides of the central opening;

a pair of opposing second leg members extending upward from the upper surface of the base member, the second leg members disposed on opposing sides of the central opening and alternatingly disposed between the first leg members, the second leg members shorter than the first leg members;

an upper cradle attached to the first leg members for receiving an upper reinforcement bar, the upper cradle comprising:

a first upper bar-support member having a pair of opposing and parallel first upper sidewalls separated by an upper channel, a second upper bar-support member having a pair of opposing and parallel second upper sidewalls separated by the upper channel, each of the first upper sidewalls substantially coplanar with an opposing one of the second upper sidewalls, and upper retaining members protruding inwardly from the opposing first upper sidewalls and the opposing second upper sidewalls to retain the upper reinforcement bar within the upper cradle; and a lower cradle attached to the second leg members for receiving a lower reinforcement bar, the lower cradle comprising:

a first lower bar-support member having a pair of opposing and parallel first lower sidewalls separated by a lower channel, one of the first lower sidewalls attached to an adjacent one of the first upper sidewalls at an angle of about 90 degrees, and another of the first lower sidewalls attached to an adjacent one of the second upper sidewalls at an angle of about 90 degrees, a second lower bar-support member having a pair of opposing and parallel second lower sidewalls separated by the lower channel, one of the second lower sidewalls attached to an adjacent one of the first upper sidewalls at an angle of about 90 degrees, and another of the second lower sidewalls attached to an adjacent one of the second upper sidewalls at an angle of about 90 degrees, each of the first lower sidewalls substantially coplanar with an opposing one of the second lower sidewalls, and lower retaining members protruding inwardly from the opposing first lower sidewalls and the opposing second lower sidewalls to retain the lower reinforcement bar within the lower cradle.

9. The apparatus of claim 8 wherein the base member, first and second leg members, upper cradle, and lower cradle comprise a unitary structural element.

10. The apparatus of claim 8 wherein the base member, first and second leg members, upper cradle, and lower cradle are formed from a continuous piece of thermoplastic material.

* * * * *